US011104559B2

(12) United States Patent
Phillips et al.

(10) Patent No.: US 11,104,559 B2
(45) Date of Patent: Aug. 31, 2021

(54) FOLDABLE PERSONNEL BASKET FOR A CRANE

(71) Applicant: Auto Crane Company, Tulsa, OK (US)

(72) Inventors: Ian R. Phillips, Tulsa, OK (US); Rowan Leehue, Tulsa, OK (US)

(73) Assignee: Auto Crane Company, Tulsa, OK (US)

( * ) Notice: Subject to any disclaimer, the term of this patent is extended or adjusted under 35 U.S.C. 154(b) by 0 days.

(21) Appl. No.: 16/688,595

(22) Filed: Nov. 19, 2019

(65) Prior Publication Data

US 2020/0109039 A1 Apr. 9, 2020

Related U.S. Application Data

(63) Continuation-in-part of application No. 15/711,279, filed on Sep. 21, 2017, now abandoned.

(60) Provisional application No. 62/437,762, filed on Dec. 22, 2016, provisional application No. 62/397,897, filed on Sep. 21, 2016.

(51) Int. Cl.
*B66F 11/04* (2006.01)

(52) U.S. Cl.
CPC ..... *B66F 11/044* (2013.01)

(58) Field of Classification Search
CPC ..... A47L 3/02; B65D 43/16
USPC ..... 312/258, 262
See application file for complete search history.

(56) References Cited

U.S. PATENT DOCUMENTS 1,868,187 A * 7/1932 Avallone ..... A47L 3/02 182/55
3,191,959 A * 6/1965 Heimbruch ..... B62B 3/02 280/641
3,472,337 A * 10/1969 Atchey ..... B66F 11/044 182/2.7
3,746,358 A * 7/1973 Swick, Jr. ..... B62B 3/02 280/651
3,840,242 A * 10/1974 Craig, Sr. ..... B62B 3/025 280/33.996
3,840,243 A * 10/1974 Rheinhart ..... B62B 3/025 280/651
3,893,686 A * 7/1975 Morgan ..... B62B 3/002 280/651
4,137,996 A * 2/1979 Brown ..... E04G 3/18 182/150
4,650,036 A * 3/1987 Matsuda ..... B66B 9/00 182/142

(Continued)

*Primary Examiner* — Colleen M Chavchavadze
*Assistant Examiner* — Shiref M Mekhaeil
(74) *Attorney, Agent, or Firm* — GableGotwals

(57) ABSTRACT

Embodiments of a personnel basket for attachment to a crane boom include folding sidewall sections; a rear wall connected to the sidewall sections; a front wall in pivotal connection to one of the folding sidewall sections; a floor in pivotal relation to the rear wall; a stalk integral to the rear wall and including a boom connection; and a cam or stop that transmits floor loads to the stalk. Because of the pivotal relationships, the personnel basket is moveable or foldable in a connected or assembled condition between a deployed (unfolded) state and a folded (fully collapsed) state. When in the deployed and folded states, the walls and floor remain connected to the personnel basket, the walls sharing a same orientation, the floor pivoting toward and away from the rear wall between a horizontal and vertical orientation.

15 Claims, 13 Drawing Sheets

(56) References Cited

U.S. PATENT DOCUMENTS 4,678,090 A * 7/1987 Ross ..... B62B 3/186 211/150
5,443,304 A * 8/1995 Fochs ..... A61H 3/04 135/67
5,480,187 A * 1/1996 Binning ..... B62B 3/025 280/79.2
6,145,619 A * 11/2000 Risser ..... B66F 11/044 182/113
7,044,178 B1 * 5/2006 Campbell ..... B25H 1/12 144/285
7,226,100 B1 * 6/2007 Willey ..... B62D 33/03 296/26.11
8,418,810 B2 * 4/2013 Barr ..... E04G 3/30 182/150
8,651,293 B2 * 2/2014 Boyer ..... B25H 3/04 211/104
8,739,928 B2 * 6/2014 Schneider ..... B66F 11/046 182/2.2
9,630,666 B1 * 4/2017 Keene ..... A01M 31/025
10,611,616 B2 * 4/2020 Miles ..... B66F 11/044
10,766,516 B2 * 9/2020 Finstad ..... B62B 3/002
2002/0153737 A1 * 10/2002 Fitts ..... B60P 3/40 296/26.11
2003/0085640 A1 * 5/2003 Chan ..... A47B 43/00 312/262
2004/0219023 A1 * 11/2004 Bird ..... F04D 29/34 416/210 R
2007/0044234 A1 * 3/2007 Barnes ..... A47D 7/002 5/93.2
2009/0096231 A1 * 4/2009 Burlingame ..... B66F 11/04 294/68.3
2013/0068558 A1 3/2013 Schneider
2014/0263902 A1 * 9/2014 Conley ..... F24S 25/634 248/222.11
2015/0119213 A1 * 4/2015 Savarino ..... A63B 69/0057 482/142
2016/0082996 A1 * 3/2016 Jackson ..... B62B 3/1476 280/33.996
2016/0257543 A1 * 9/2016 Hufnagl ..... B66F 11/044
2017/0044807 A1 * 2/2017 Clark ..... E05F 17/00

* cited by examiner

FOLDABLE PERSONNEL BASKET FOR A CRANE

CROSS REFERENCE TO RELATED APPLICATIONS

This application is a continuation-in-part application which claims priority to U.S. patent application Ser. No. 15/711,279, filed Sep. 21, 2017, which claimed priority to U.S. Provisional Application No. 62/397,897 filed Sep. 21, 2016 and 62/437,762 filed Dec. 22, 2016.

BACKGROUND

This invention is in the field of personnel baskets, also called man baskets or suspended work platforms. More specifically, the invention relates to foldable personnel baskets intended for use with a lifting device such as a crane boom.

Prior art personnel baskets are either permanently mounted to the crane boom or, when disconnected from it, stowed in full-size state either in a truck bed or on the truck hitch. Some baskets that do collapse into a smaller size are either too wide for use with a crane boom or do not include features that make them appropriate for use with a crane boom.

Other commercially available baskets may be stored on the bed of the mechanic truck, taking up valuable storage space. Still other baskets on the market are mounted on a trailer hitch at the rear of the truck when not in use, thereby creating an obstacle impeding access to other equipment on the truck. Prior art personnel baskets are either too wide or missing some of the required features for use with a crane boom.

US 2016/0257543 to Hufnagl et al. discloses a personnel basket that can connect to a crane boom. The basket includes a collapsible spine (stalk or mast) that folds downward toward the basket's floor to cover a middle third of the floor, between the left and right thirds of the floor which then pivot upwards along each side of the now-folded spine. A foldable rail assembly (walls) is removably mountable on the spine and to the basket. The rail assembly cannot be moved into a stowed state while connected to the basket because doing so would prevent the spine from folding downward toward the floor or, if already folded, prevent the rail assembly from folding inward. The portion of the rail assembly connected to the spine must also be removed prior to folding the spine to prevent its interference with the upward pivoting floor sections. The same is true of the front and side rail assemblies. Therefore, when in a stowed state, the spine and floor remain connected to one another, but the rail assembly must be detached and separately stowed. The floor in both the deployed and stowed states remains in a horizontal orientation.

SUMMARY

Figure 2:
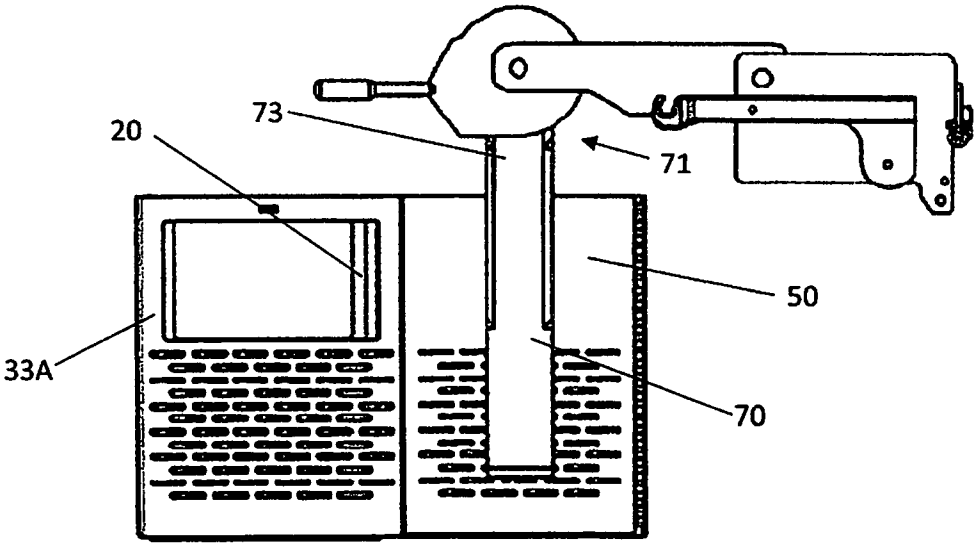
FIG. 2 is a front elevation view of the basket still in the folded state and positioned for unfolding or deployment.

Embodiments of a personnel basket for attachment to a crane boom include left and right sidewalls made up of a fixed sidewall section and a pivoting or folding sidewall section; a rear wall in fixed relation to the fixed sidewall sections; a front wall in pivotal relation to a corresponding one of the folding sidewall sections; a floor in pivotal relation to the rear wall; and a stalk (spine or mast) connected to the rear wall and including a boom connection at an upper end. The walls are connected to the floor when the basket is deployed, with locking bars at the tops of the walls to lock the walls inline with one another.

In some embodiments, the stalk forms an integral portion of the rear wall, with a fixed (non-folding, non-pivoting) rear wall section located left and right of the stalk and connected to it. The stalk may have a fixed length or height or an adjustable one. The stalk may be a two-piece stalk, with an upper portion of the stalk being received by a lower sleeve portion connected to the rear wall. The stalk is an integral portion of the rear wall. In other words, the rear wall cannot be disconnected from the stalk (or vice versa).

Because of the pivotal relationships, the personnel basket is moveable or foldable between a deployed (unfolded) state and a folded or fully collapsed state and may be stowed as a single, connected or assembled unit. When in the deployed state, the folding sidewall sections are in a vertical orientation and are perpendicular to the vertically oriented rear and front walls and the horizontally oriented floor. In the deployed state, the floor in a horizontal orientation (not at an oblique angle) and stays in that orientation throughout its range of travel up and down.

A hinge block connects the floor to the stalk and a cam or stop at the rearward end of the floor transmits downward force on the floor to the stalk. No external frame is required to support the floor.

The basket may be deployed before connection to the crane. During the folding steps, the folding sidewall sections remain in the vertical orientation, as do the rear and front walls, and are parallel to the rear and front walls and the floor, which is now in a vertical orientation. When in the folded state, the stalk, walls, and floor remain connected to one another, with the basket being stored as a single unit. The stop no longer bears any load of the floor.

A perimeter or footprint of the basket when in the folded state is less than that when in the deployed state (the footprints lying in a horizontal plane perpendicular to the rear wall and being measured when the rear wall is in a vertical orientation). In embodiments an overall depth (front-to-back) of the basket when folded is less than half that of the basket when unfolded. When disconnected from the boom, the personnel basket when in the folded state may be stowed in a vertical or horizontal orientation for storage or transport. When folded, each portion of the basket is in a same orientation as all other portions.

The left and right sidewalls, as well as the front wall, may each include a flange located at a bottom end. In some embodiments, the sidewall flanges include pins that are received by corresponding holes of the floor. A sliding locking plate may then be used to lock the pins.

The rear wall, the left and right sidewalls, and the front wall may each include a railing along a top end. The railing may be in fixed relation to its respective wall. In some embodiments, the front wall includes, or is, a doorway. In other embodiments, the doorway is located on a sidewall. The sidewalls may be folding sidewalls, connected at one end in pivotal relation to the rear wall and at another end in pivotal relation to the front wall.

DETAILED DESCRIPTION

Embodiments of a foldable personnel basket of this disclosure are configured for attachment or connection to a crane boom and move or fold when connected to the boom between a folded or fully collapsed state and a deployed (unfolded) state. During folding and unfolding, the basket may be disconnected from the crane and the walls of the basket maintain a vertical orientation, with the floor pivoting between horizontal and vertical. In embodiments, the floor is cantilevered, there being no separate frame under the floor to support the floor or that remains stationary and does not fold with the floor. The cam or stop is used to transmit the downward force to the rear of the stalk (and therefore essentially to the crane to which the basket is attached).

The connection to the crane boom may include a pin. In some embodiments, the connection includes a locking mechanism or locking position that engages when the basket is being deployed. When deployed, a falling object protection screen of a kind well known in the art may be fitted onto the basket.

The basket may be made of aluminum or other light weight structural material to ease handling, preserve truck payload, and resist rust. In some embodiments, and by way of a non-limiting example, the basket may be about 40 inches (101.6 cm) tall and 32 inches (81.3 cm) wide. The basket may be rated for a 300 lb (136 kg) load. In other embodiments, the basket is rated for a 350 lb. (159 kg) load. Embodiments may be designed and manufactured in accordance with one or more of the following standards:

ASME B30.23; and

OSHA 29 CFR Part 1926.

Embodiments of a foldable personnel basket of this disclosure may include a rear wall including a stalk integral to the rear wall and forming a fixed midsection of the rear wall, the stalk including a boom connection located toward an upper end of the stalk; a left and a right sidewall, each sidewall including: a fixed sidewall section fixedly connected at a rearmost end to the rear wall, a folding sidewall section pivotally connected to a foremost end of the fixed sidewall section, the folding sidewall section having a greater length than the fixed sidewall section, and a top rail including a locking bar configured to align the folding sidewall section with the fixed sidewall section; a front wall pivotally connected to a corresponding one of the folding sidewall sections; and a one-piece floor in pivotal relation to the rear wall; wherein the left and right sidewalls, the front wall, and the floor pivot toward and away from the rear wall between a deployed state and a folded state, the rear wall remaining in s fixed position between the deployed and folded states; wherein when in the deployed state the floor is perpendicular to the rear wall and when in the folded state the entire floor overlaps the rear wall.

The stalk may include a hinge block at its bottom end including a pin connecting the floor to the stalk; and the floor may include a cam or stop at a rearward end; wherein when in the deployed state a face of the stop contacts the rear wall and when in the folded state the face of the stop does not contact the rear wall. Cam as used in this disclosure means a device that transmits or bears a load when the device is in a first (vertical) orientation but does not transmit or bear the load when in a second (horizontal) orientation orthogonal to the first. In embodiments of this disclosure the cam is part of the floor assembly and provides a pivot point for it, as well as a physical stop. When the floor is in the deployed position (perpendicular to the stalk), one face of the cam comes into contact with the rearward surface of the stalk or rear wall which stops further rotation downward by the floor. The cam face that contacts the stalk also serves to redirect some of the downward force of the floor itself (both unloaded, but more importantly when loaded) to the back of the stalk, placing the stalk tube or sleeve under a compressive load. The other portion of the downward force is transmitted through the pin that connects the floor to the stalk. In essence, when loaded, the cam or stop essentially tries to twist the stalk.

Figure 1:
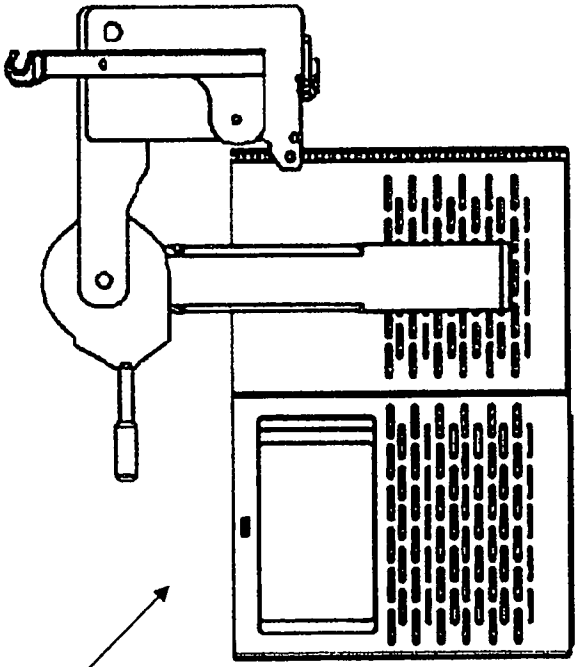
FIG. 1 is front elevation view of an embodiment of a foldable man basket of this disclosure when in a folded state under a crane boom.
Figure 4:
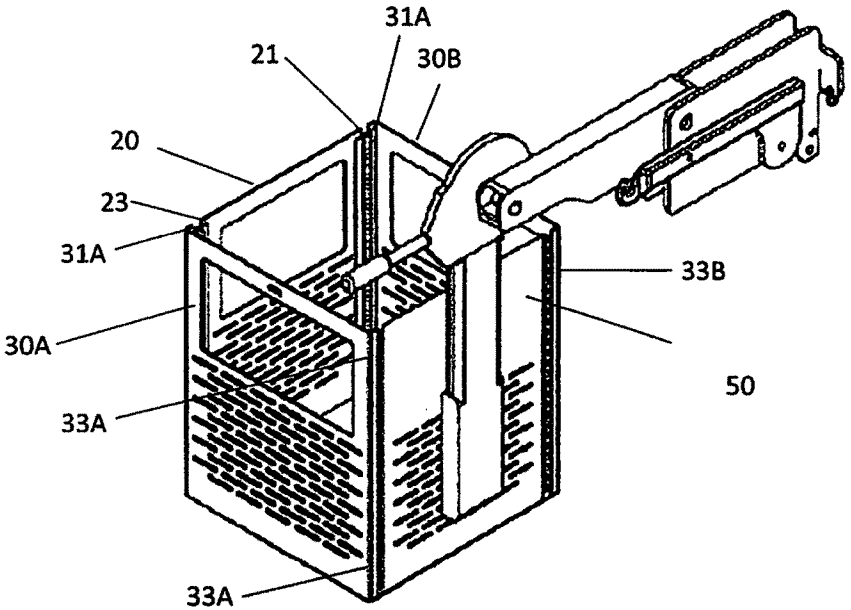
FIG. 4 is an isometric view of the basket when in a fully deployed (unfolded) state.
Figure 3:
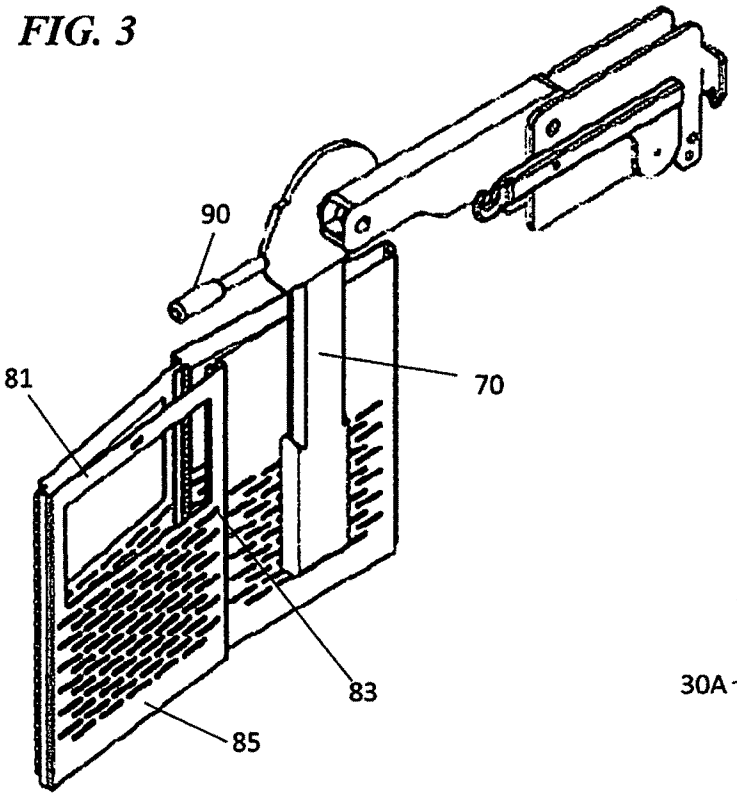
FIG. 3 is an isometric view of the basket in the folded state.
Figure 5:
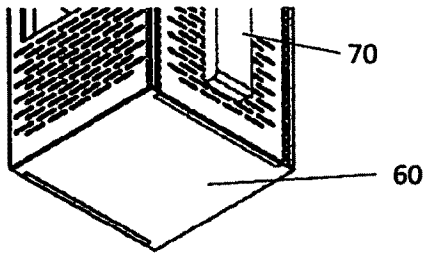
FIG. 5 is an isometric (partial) view of a bottom end of the basket when in the deployed stated.

Referring to FIGS. 1 to 5, embodiments of a personnel basket 10 includes a front wall 20, a rear wall 50, left and right sidewalls 30A, 30B, and a floor 60. The floor 60, which provides a support platform, is in hinged or pivotal relation to the rear wall 50. The walls 20, 30 are in pivotal relation to one another and the rear wall 50, the rear wall 50 being fixed. In embodiments, the front wall 20 is pivotally connected at each end 21, 23 to an adjacent end 31A, 31B of the sidewalls 30A, 30B. One of the sidewalls 30 serves as a doorway. A locking mechanism (not shown) may be included at one end 33A (or 33B) of the doorway sidewall 30 to keep the doorway in a closed position. The sidewall 30 not being used as the doorway is pivotally connected at its end 33B (or 33A) to the rear wall 50. The rear wall 50 includes a mast or stalk 70 that may be connected to the wall 50 or form part of the wall 50. The stalk 70 includes a crane boom connection 71 located toward an upper end 73 of the stalk 70. In some embodiments, the stalk 70 is a two-piece stalk, with an upper portion of the stalk 70 being received by a lower sleeve portion connected to the rear wall 50. The lower sleeve portion may extend just above the railing 81.

The walls 20, 30, 50 may be made up of a top rail 81, an intermediate (mid) rail 83, and a toe rail or board 85 all in fixed relation to their respective wall. By way of a non-limiting example, the floor 60 may be 30 in.×30 in. (76 cm×76 cm) with a slip resistant surface of a kind known in the art. Means for providing water drainage may also be provided. The toe board may be at least 4 in. (11 cm) tall. The top rail 81 may be in a range of 40 in. to 44 in. (101.6 cm to 111.8 cm) from the floor 60, with the mid-rail 83 located an equal distance between the top rail 81 and the floor 60. The top rail 81 may withstand a 300 lb. (136 kg) force applied outward or downward without adversely deflecting or breaking the rail 81. In other embodiments, the top rail 81 may withstand a 350 lb. (159 kg) force.

In some embodiments, the mid-rail 83 to toe-rail 85 distance may be enclosed with a flexible material such as but as not limited to plastic. For example, the flexible material may be one that meets a ½ in. (13 mm) opening requirement and can withstand a 300 lb. (136 kg) force spread over a one square foot (0.1 sq. m) area. (Or, in some embodiments, a 350 lb. (159 kg) force.) A suitable vinyl material or its equivalent is acceptable to save weight.

Embodiments of the personnel basket 10 may self-leveling, using gravity as the means of leveling the basket 10 as the crane boom moves throughout its boom range. A hand brake 90 may be included to keep the basket 10 positioned within a predetermined angle relative to horizontal and maintain that basket 10 in position when a predetermined maximum load is applied anywhere along the top rail 81. For example, the hand brake 90 may keep the basket 10 positioned within 10° of horizontal once the brake 90 is engaged and hold the basket 10 in position with a 300 lb. (136 kg) force applied anywhere along the top rail 81. The hand brake 90 may also be arranged to help slow the leveling of the basket 10 when disengaged.

In some embodiments, positioning control of the basket 10 can be by means known in the art such as wireless control of the crane (e.g. AUTOCRANE® NEXSTAR™ remote). The basket 10 can be provided with a cradle (not shown) to keep the remote stored in the basket 10 while in use. A toolbox (not shown) of a kind known in the art may be mounted on the basket 10 to store tools.

Regarding fall arrest and safety, an anchor point for the basket 10 should be provided on the crane boom separate from that of the personal protective equipment ("PPE") anchor or tie-off point. In some embodiments, the basket tie-off point may be rated for 5,000 lb. (2268 kg) force according to OSHA 1926. Anti two-blocking ("A2B") equipment should remain attached and in place at all times.

Figure 7:
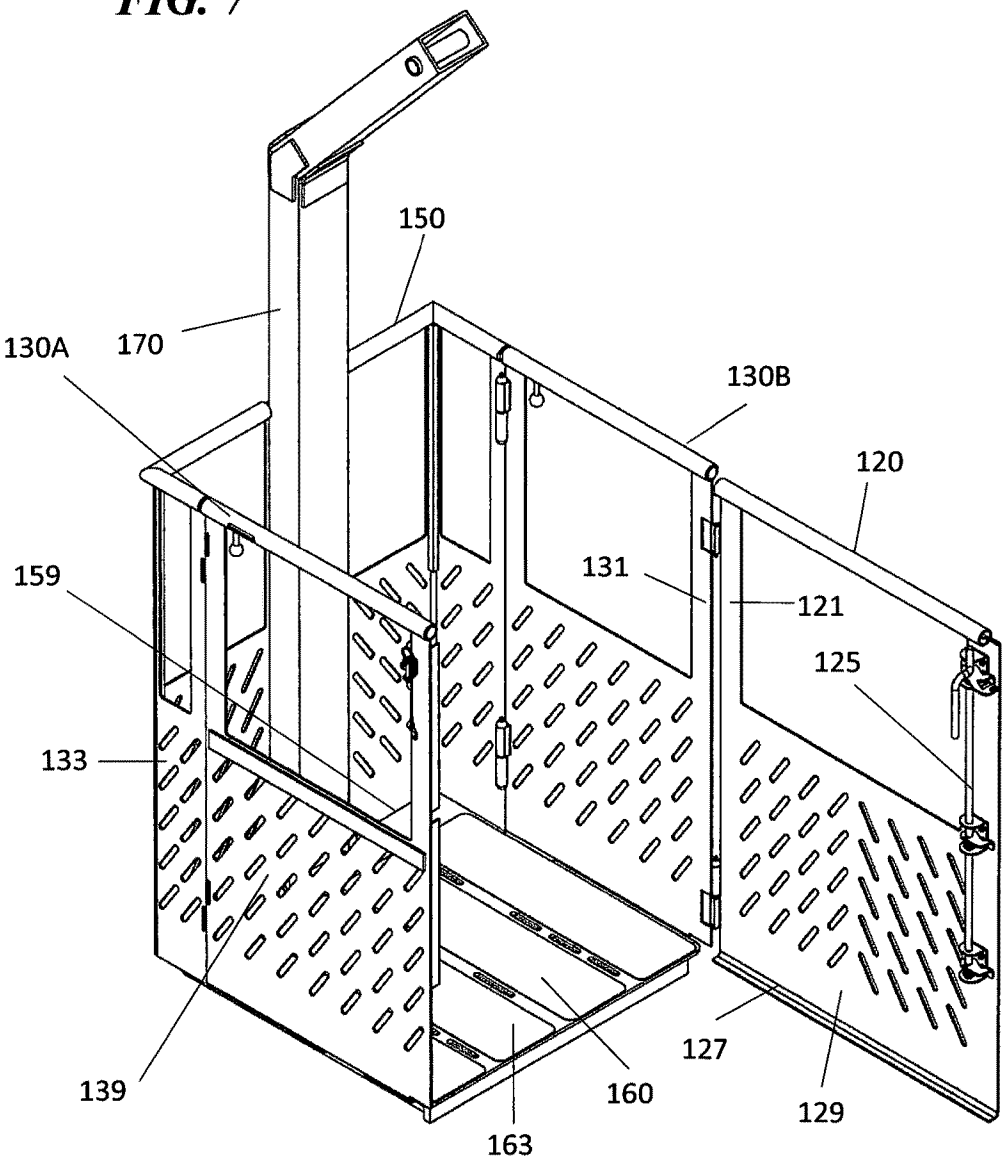
FIG. 7 is an isometric view of the basket of FIG. 6 after the first folding step is completed. The basket may be disconnected from the crane during folding.
Figure 6:
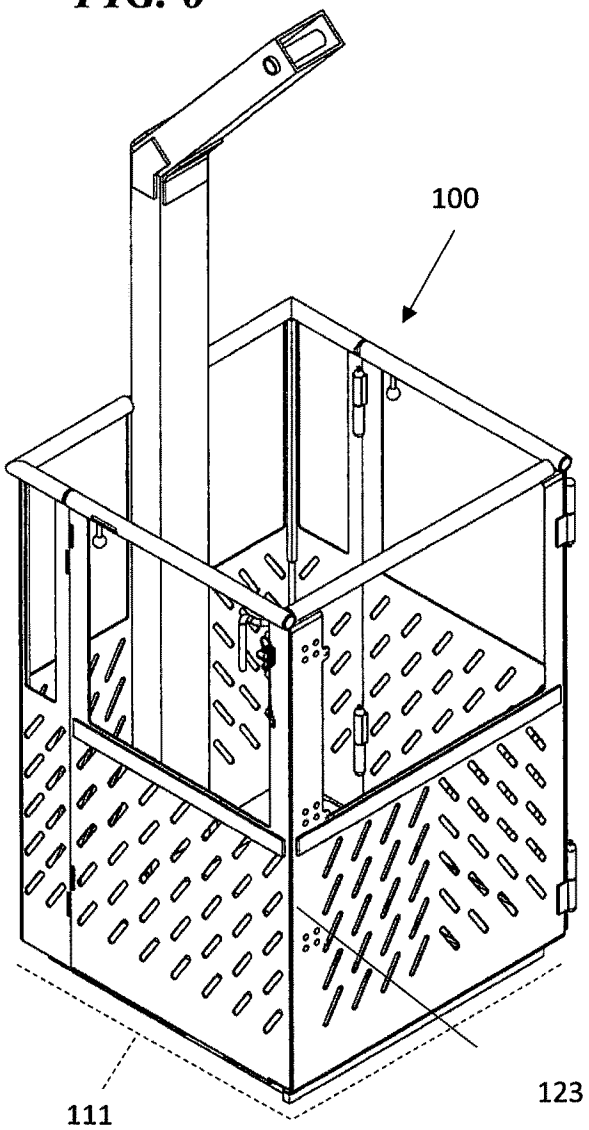
FIG. 6 is an isometric view of another embodiment of a foldable personnel basket of this disclosure. The basket is shown in its fully deployed (unfolded) state.
Figure 9:
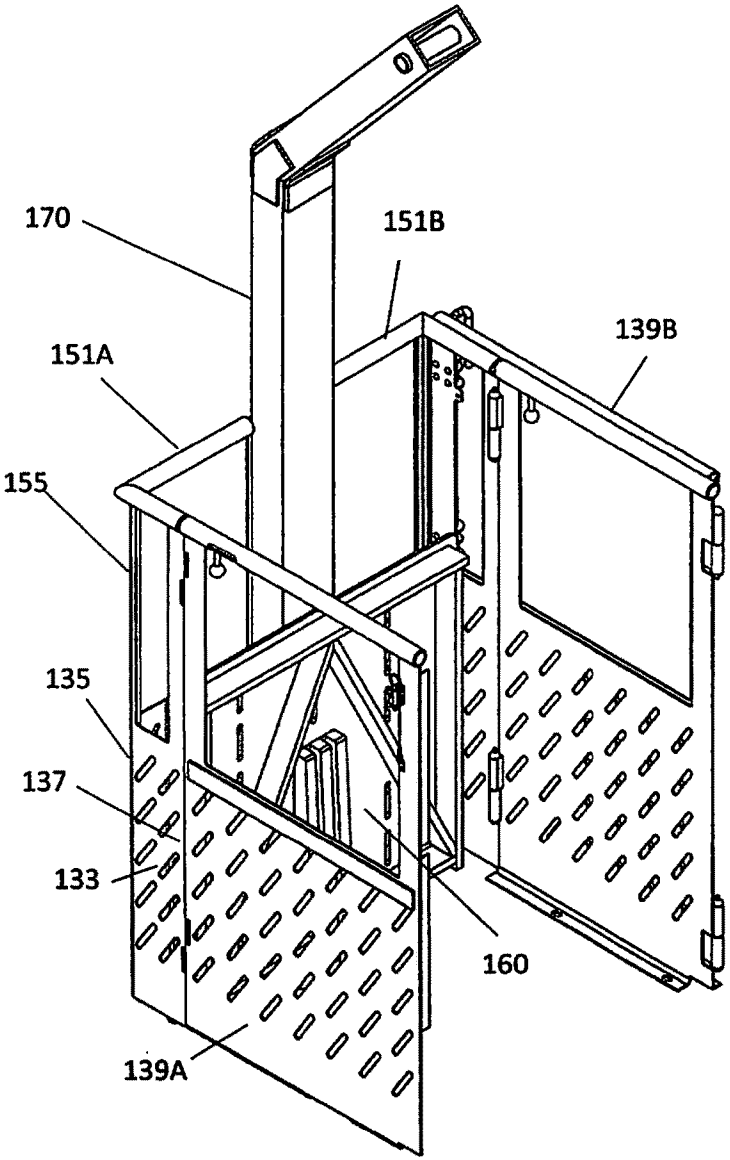
FIG. 9 is an isometric view of the basket of FIG. 6 after the third folding step is completed.
Figure 8:
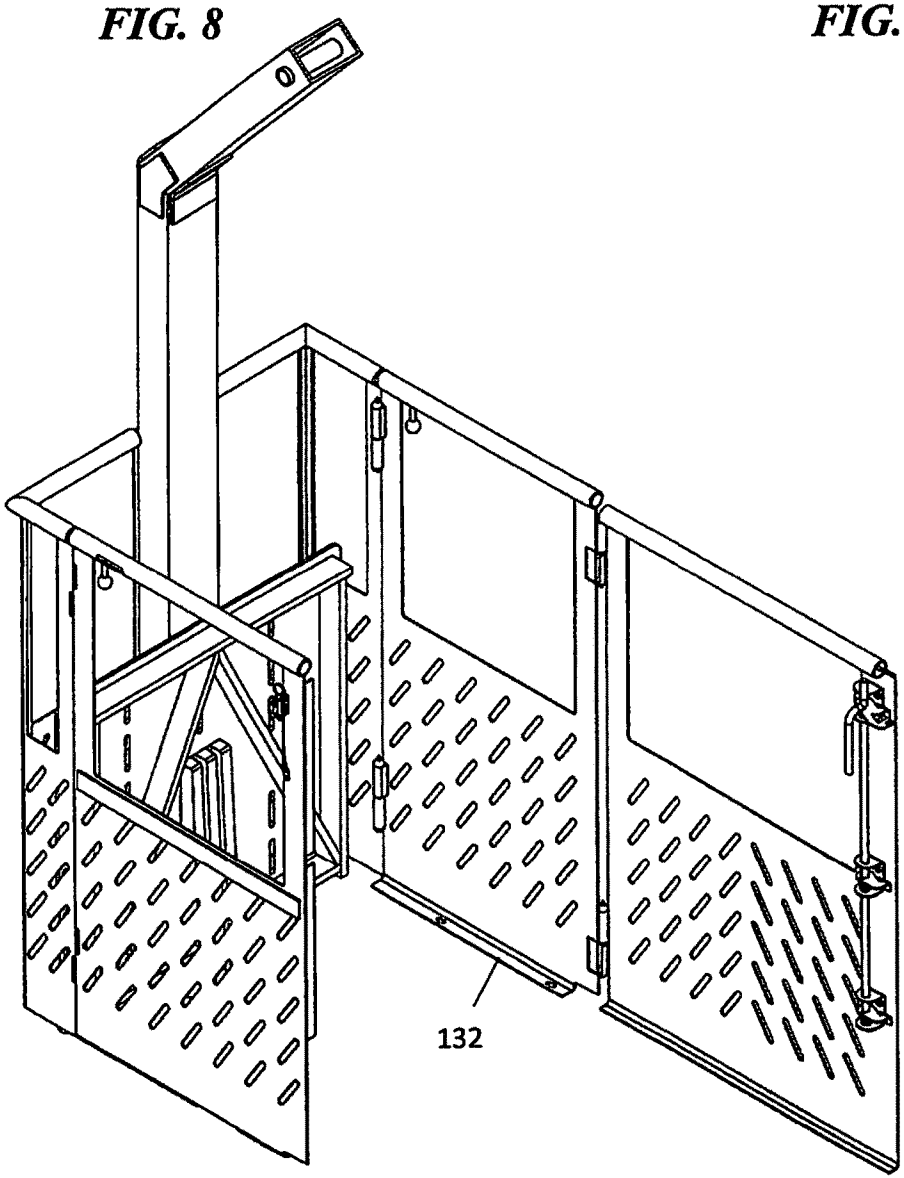
FIG. 8 is an isometric view of the basket of FIG. 6 after the second folding step is completed.
Figure 11:
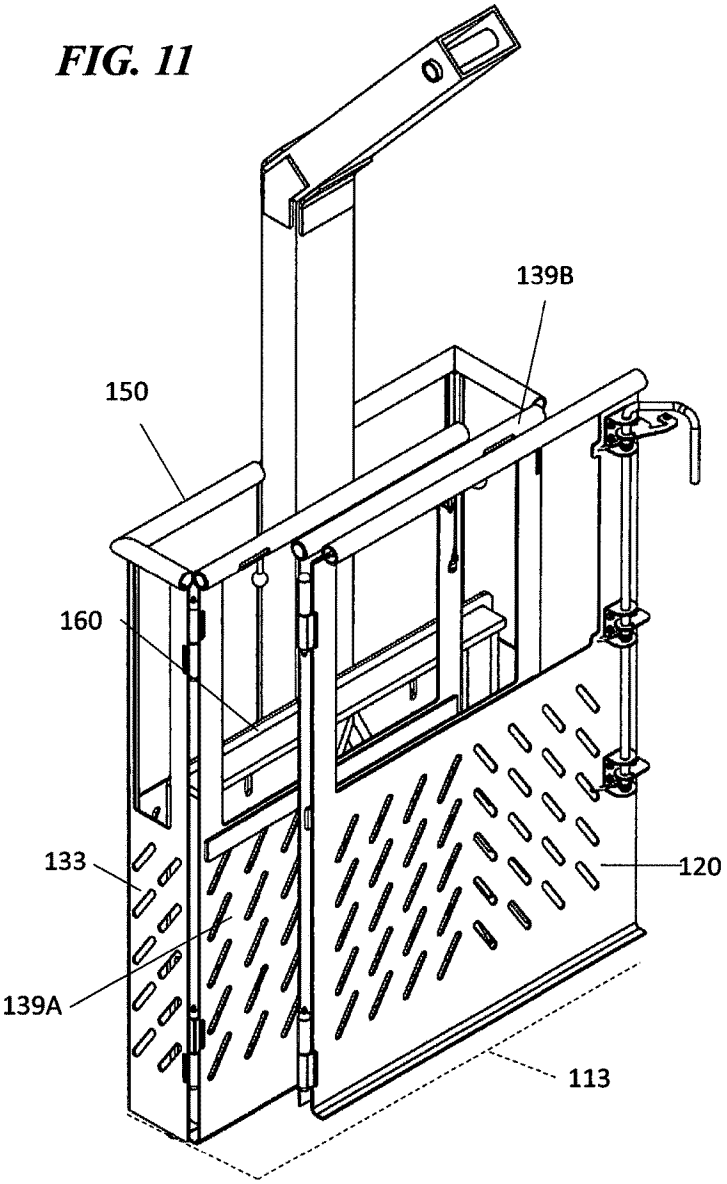
FIG. 11 is an isometric view of the basket of FIG. 6 in its folded or fully collapsed state, after the fifth, and last, folding step is completed. The basket may be stowed independent of the crane boom in a vertical or horizontal orientation. The personnel basket deploys from this folded state in a reverse manner starting with the fifth (un)folding step and ending with the first (un)folding step.
Figure 10:
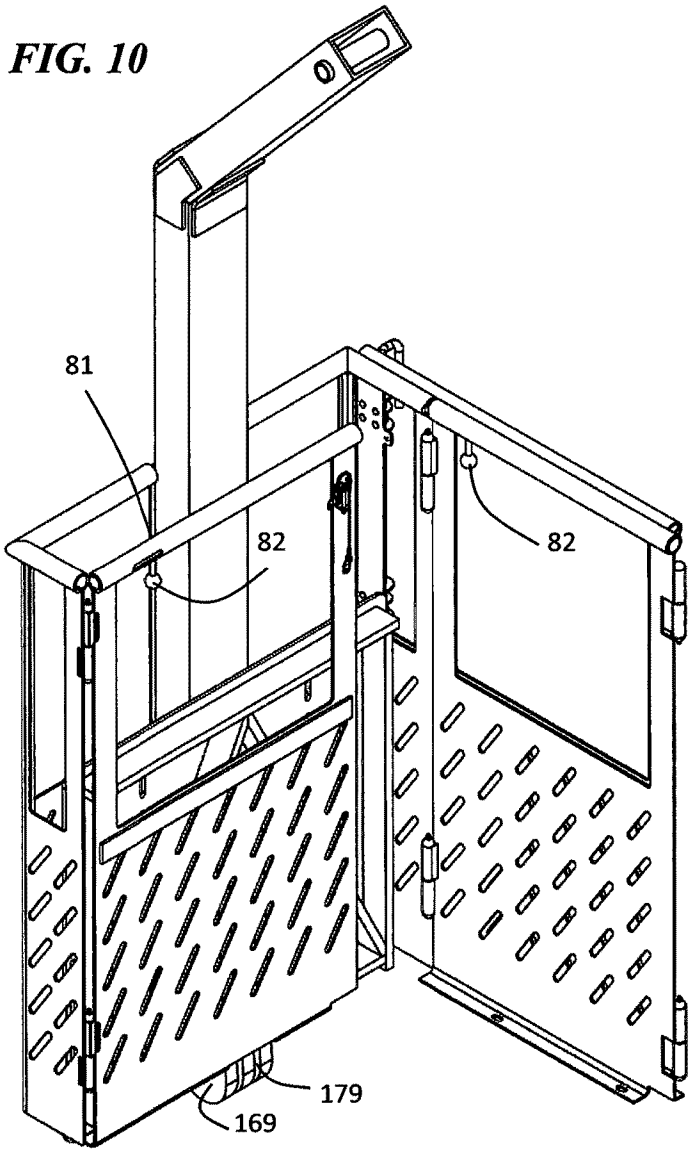
FIG. 10 is an isometric view of the basket of FIG. 6 after the fourth folding step is completed.
Figure 12:
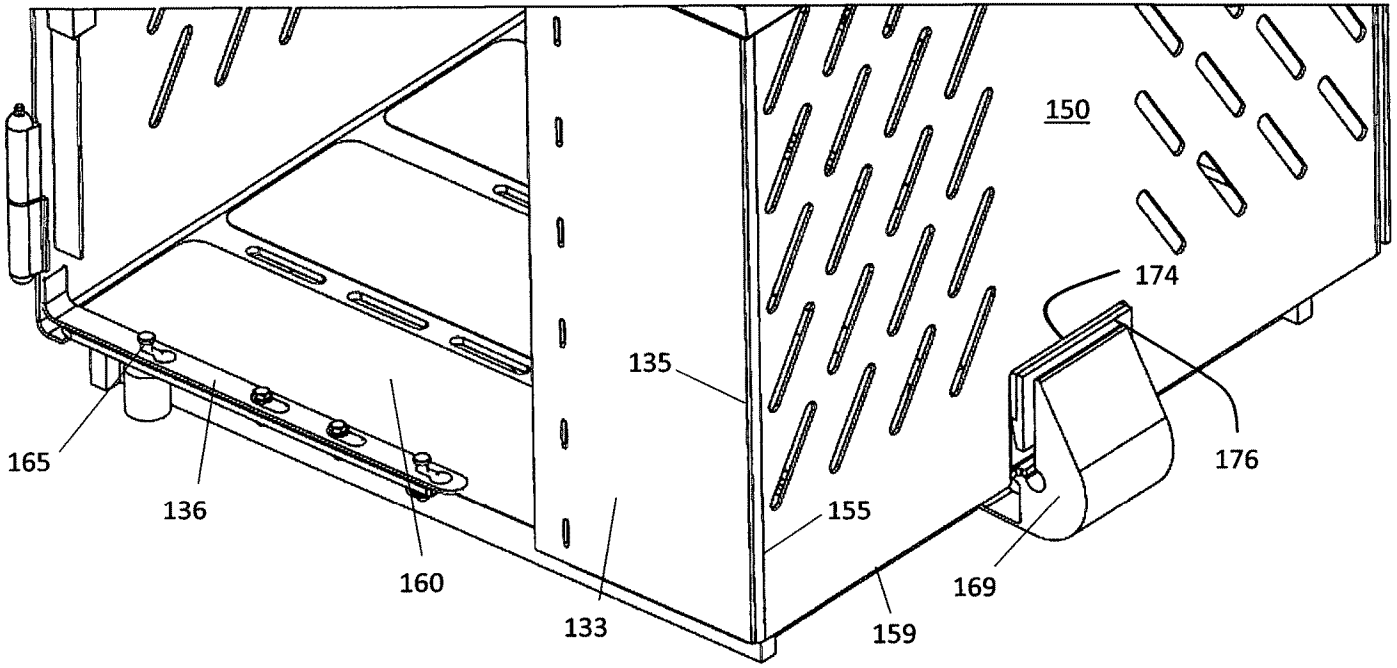
FIG. 12 is an isometric detail view of the basket of FIG. 6 showing an embodiment of a sliding locking plate arrangement used to connect the sidewalls and floor. The sliding lock is shown in the locked position.
Figure 13:
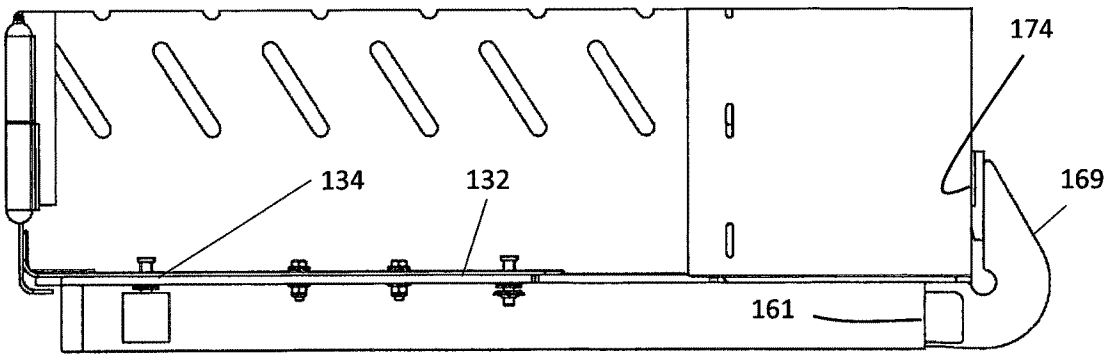
FIG. 13 is a front elevation view of the floor pin arrangement of FIG. 12.
Figure 15:
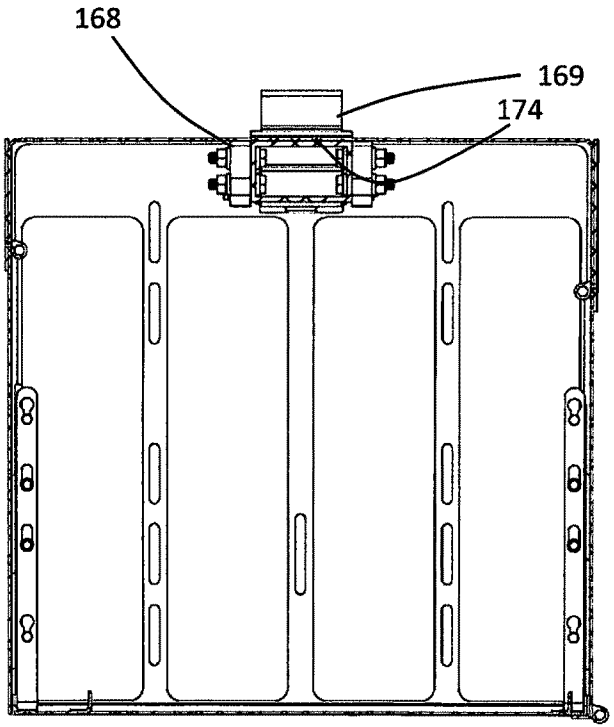
FIG. 15 is a view taken along section line 15-15 of FIG. 14.
Figure 14:
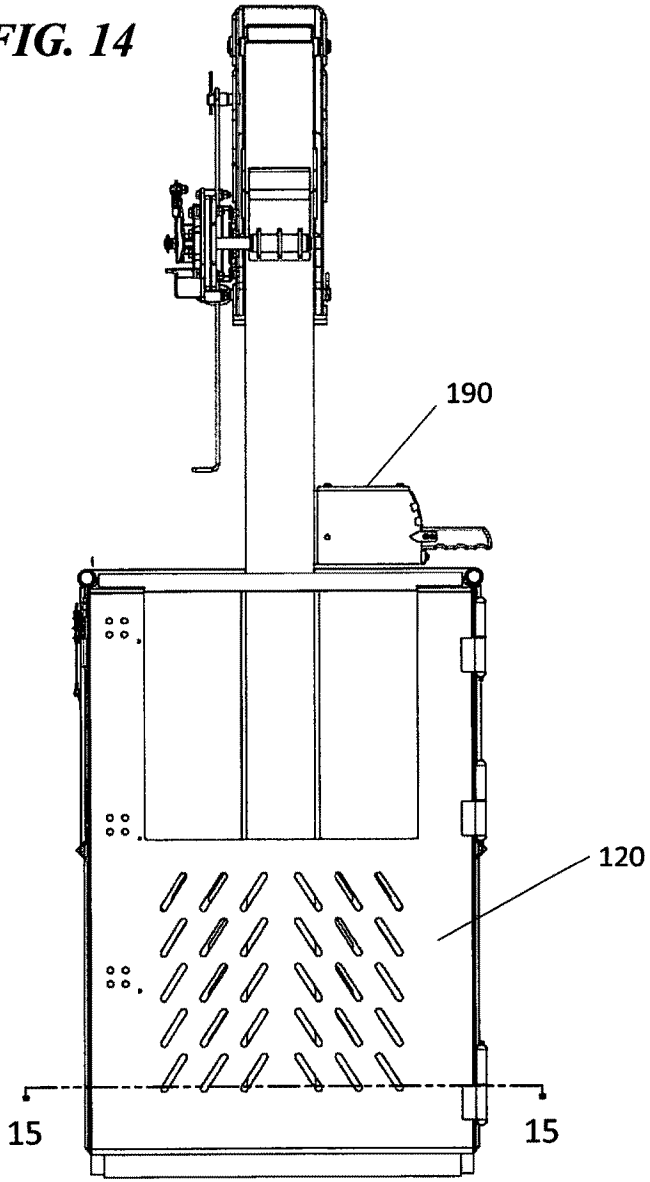
FIG. 14 is a front elevation view of an embodiment of the personnel basket of FIG. 6.
Figure 17:
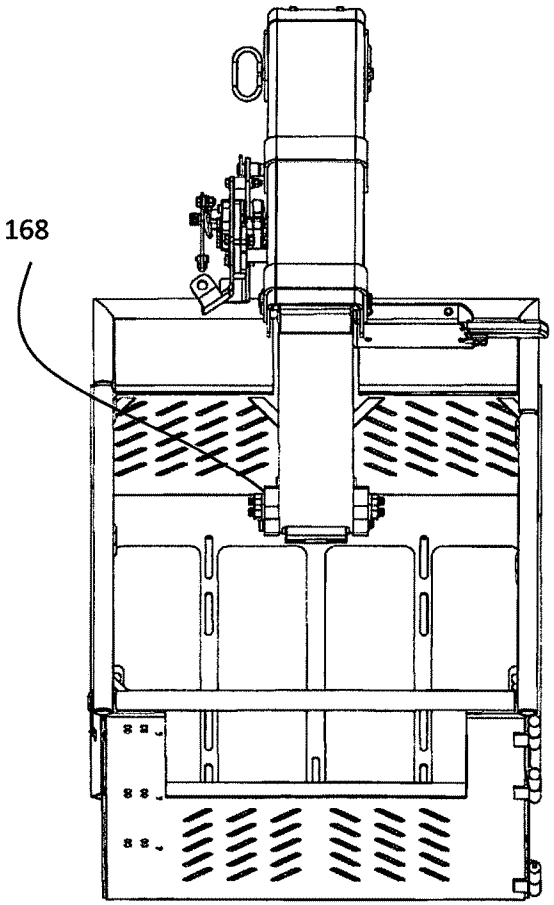
FIG. 17 is a top isometric view of the basket of FIG. 16.
Figure 16:
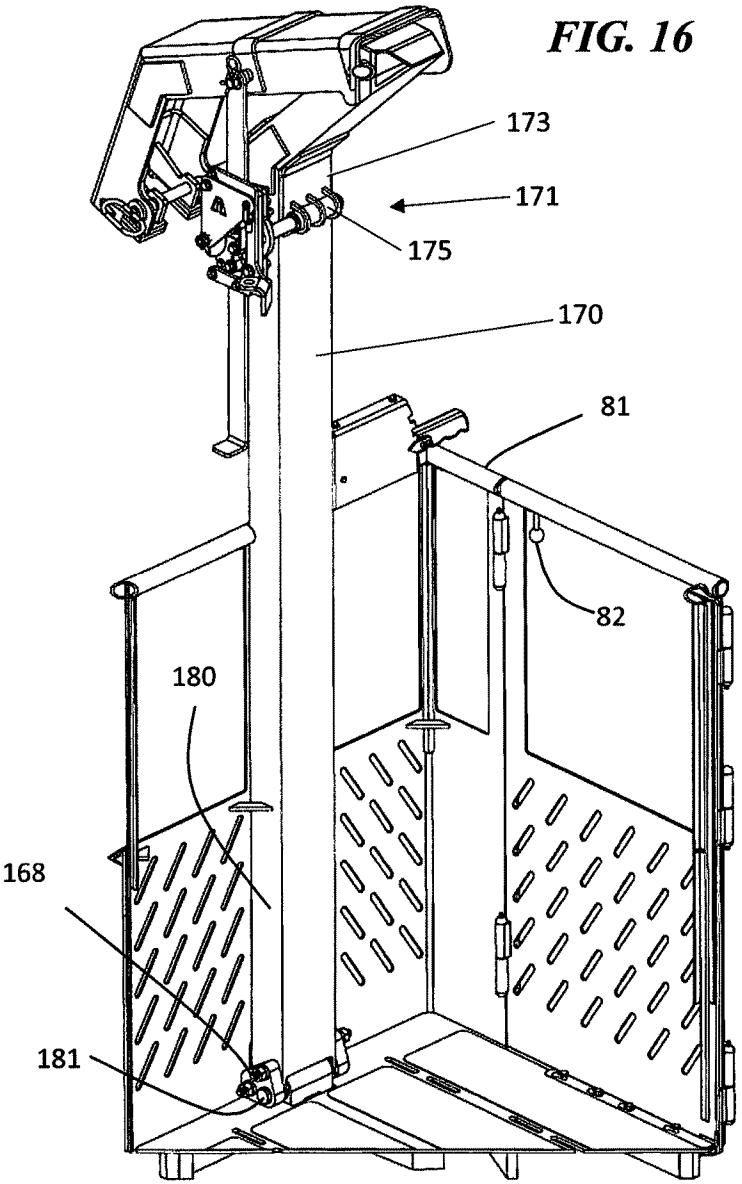
FIG. 16 is an isometric detail view of the basket of FIG. 6 showing an embodiment of the hinge block connecting the floor to the rear wall including the stalk.
Figure 19:
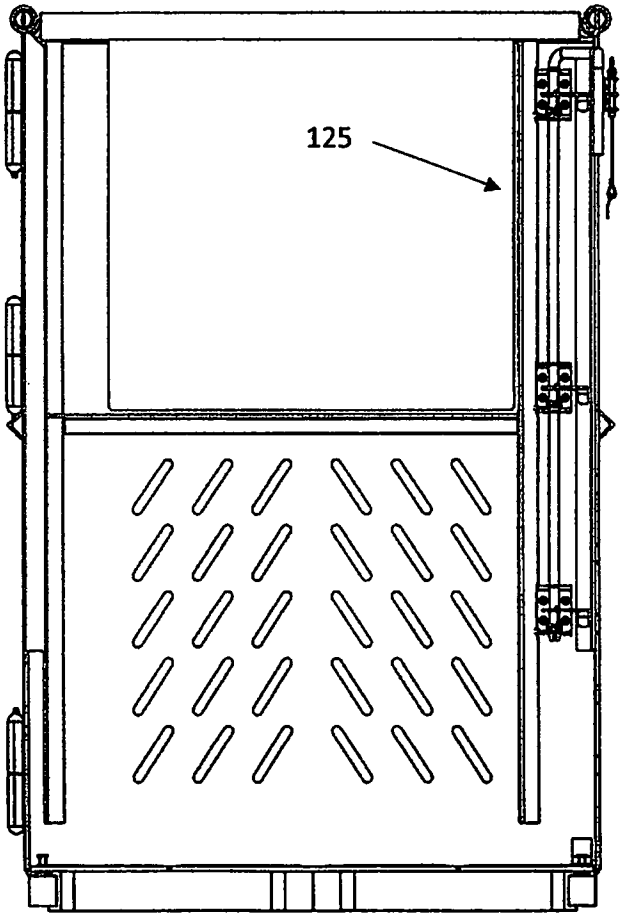
FIG. 19 is a rear elevation view of the basket of FIG. 18.
Figure 18:
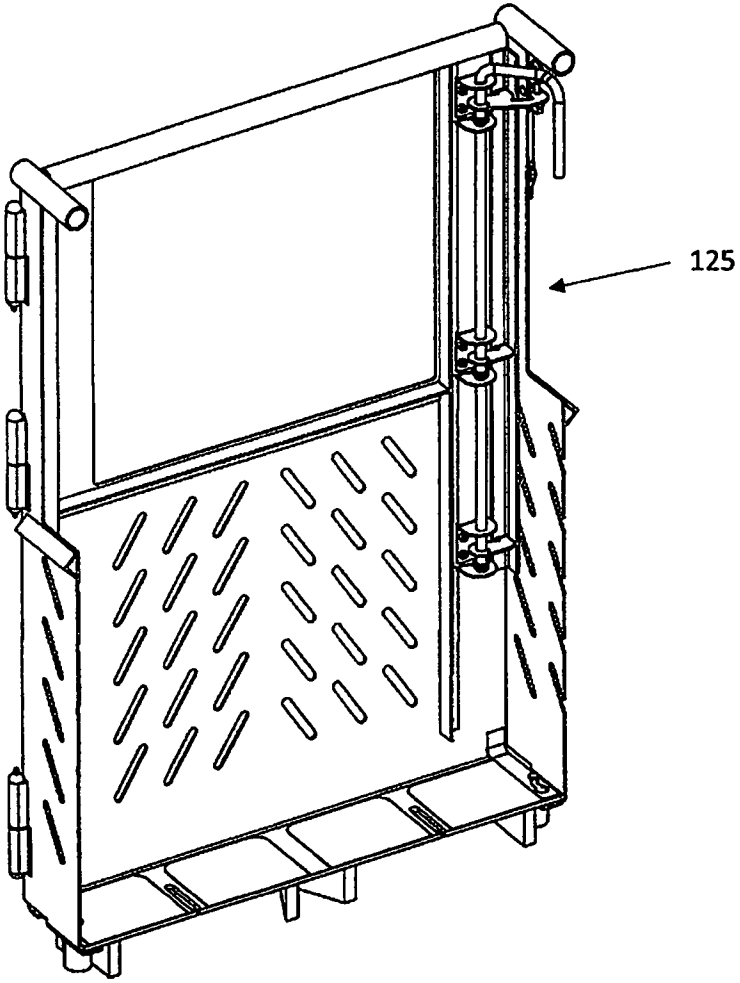
FIG. 18 is an isometric detail view of an embodiment of the latch used to secure the front wall to the sidewall of the basket of FIG. 6.
Figure 21:
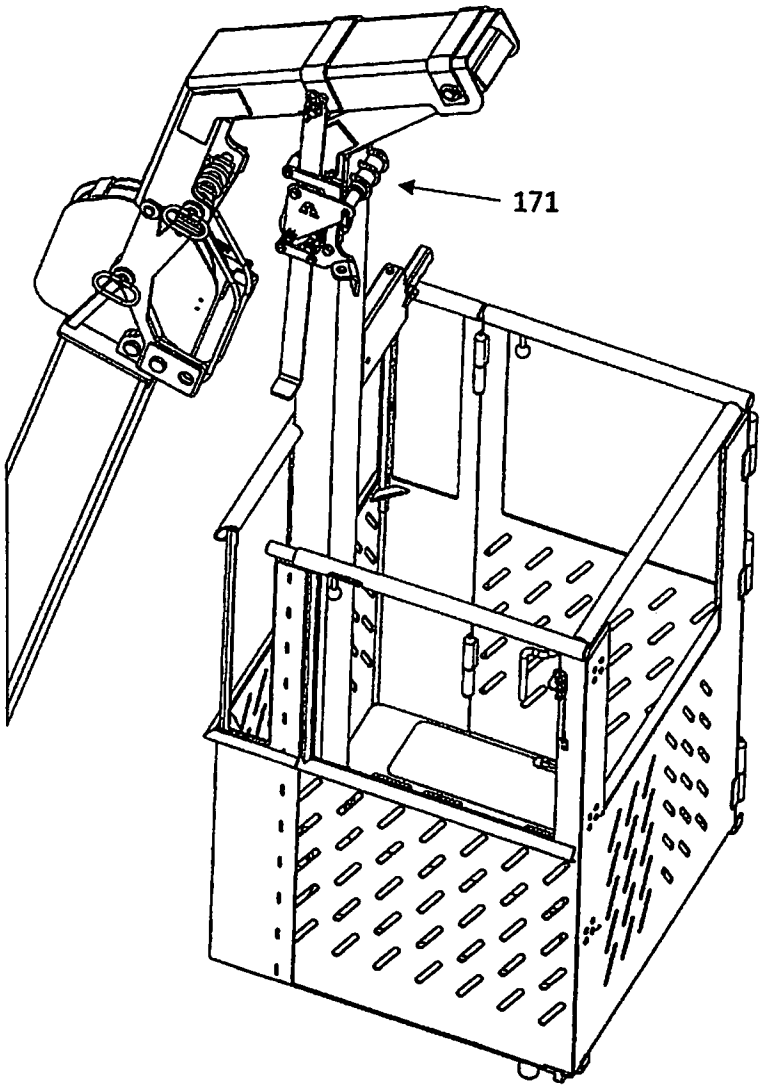
FIG. 21 is an isometric view of the basket of FIG. 20.
Figure 20:
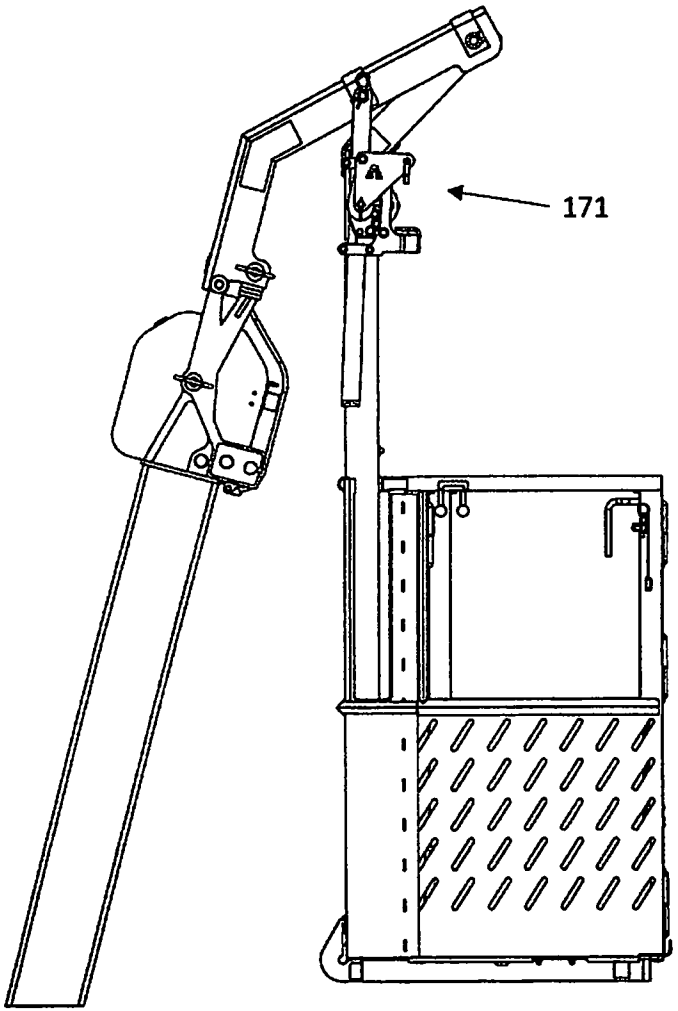
FIG. 20 is a side elevation view of an embodiment of the crown attachment used in connection with the basket of FIG. 6.
Figure 23:
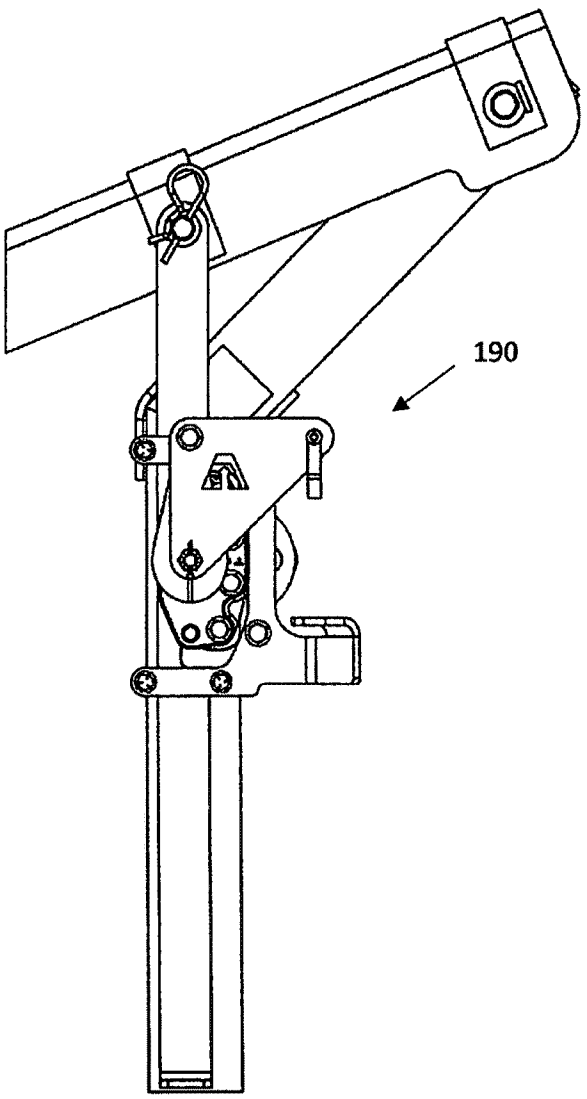
FIG. 23 is a front elevation view of the brake of FIG. 22.
Figure 22:
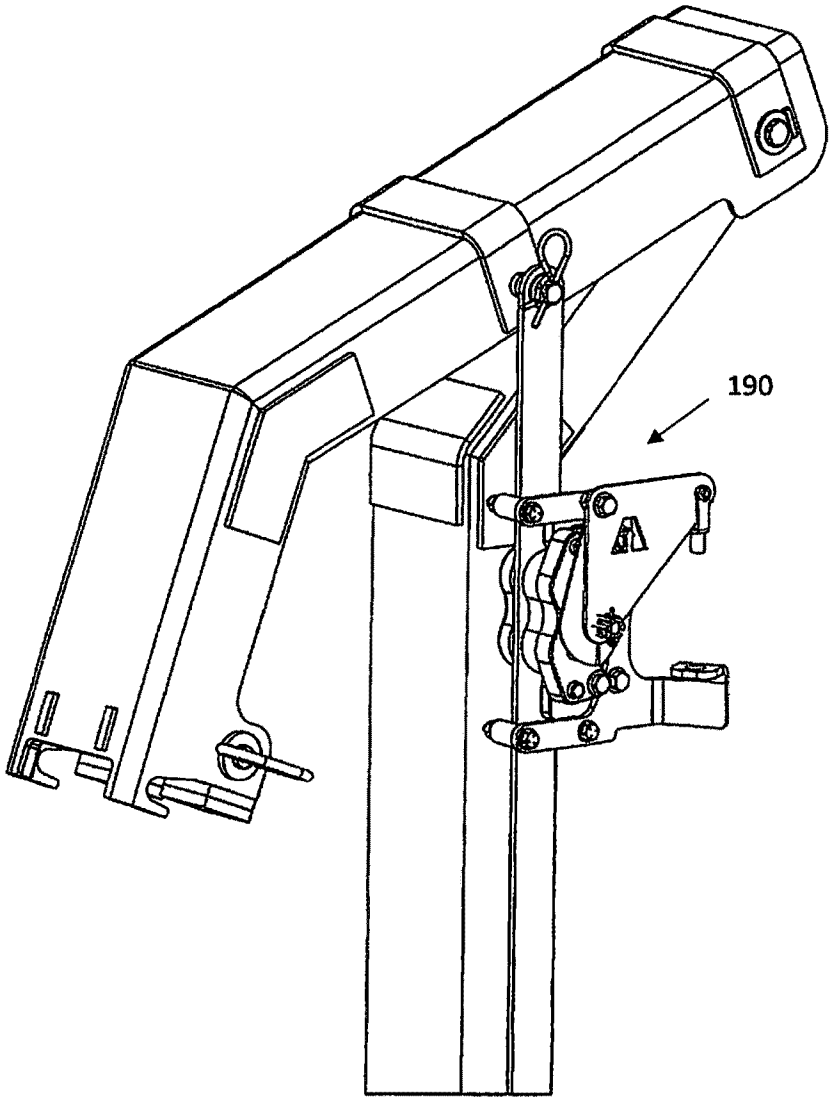
FIG. 22 is an isometric view of an embodiment of the brake of FIG. 20.
Figure 26:
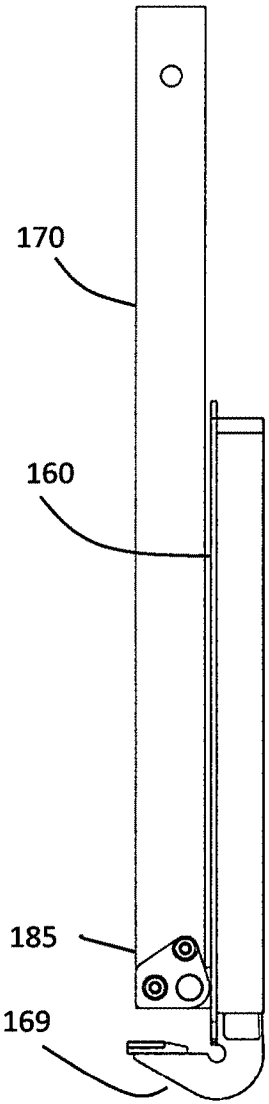
FIG. 26 is a side elevation view of the floor of FIG. 24 when in a stowed position. See also FIGS. 10 & 11.
Figure 25:
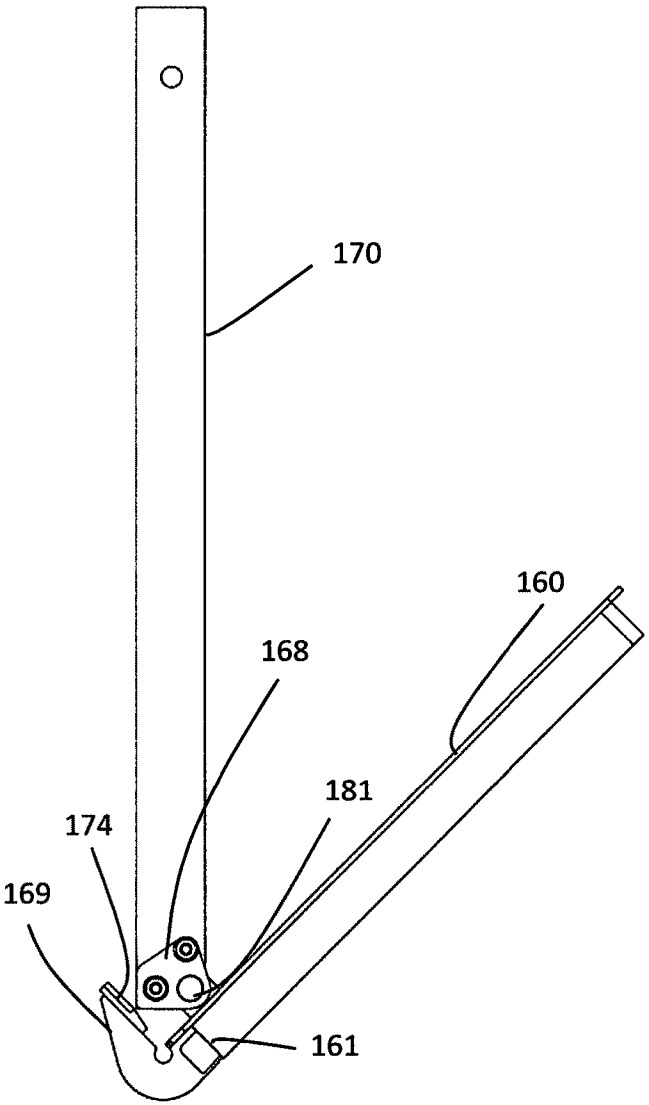
FIG. 25 is a side elevation view of the floor of FIG. 24 when moving between the deployed and stowed positions.
Figure 24:
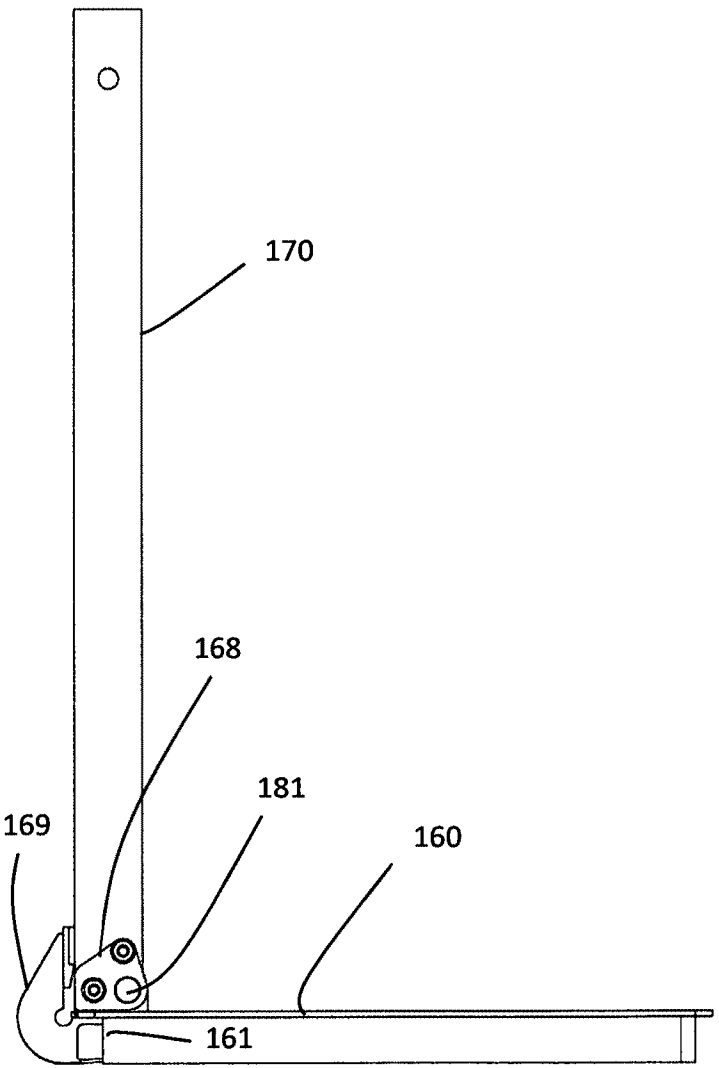
FIG. 24 is an illustrative side elevation view of the floor of the personnel basket of FIG. 6 when in a deployed position in relation to the stalk. See also FIGS. 12, 13, 15, and 20. Components other than the stalk, the floor, and the associated hinge components are removed for purposes of the illustration. A cam or stop transmits downward force on the floor to the stalk. The stalk may be a two-piece stalk, with an upper portion of the stalk being received by a lower sleeve portion connected to the rear wall.
Figure 28:
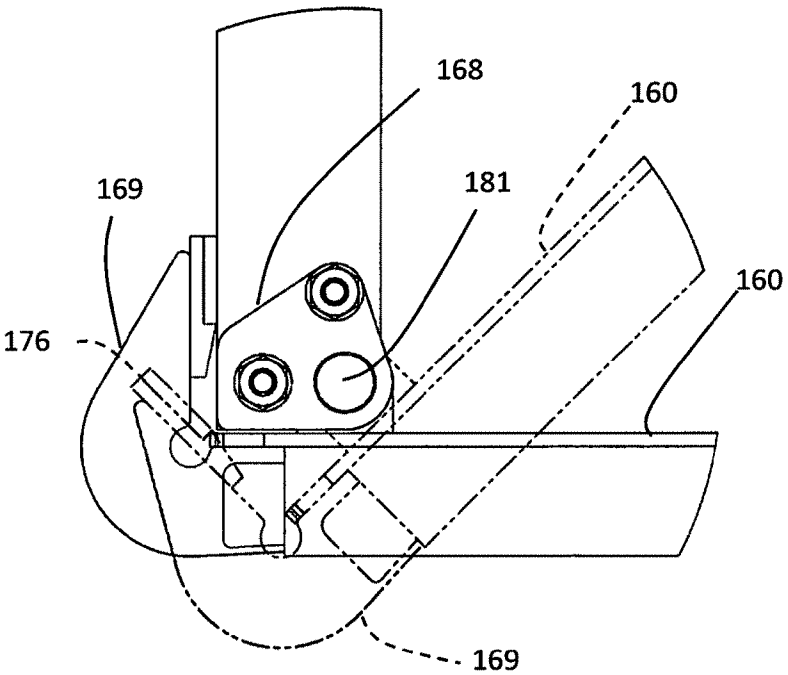
FIG. 28 is an enlarged view of the structural relationship shown in FIG. 26 between the cam and stalk.
Figure 27:
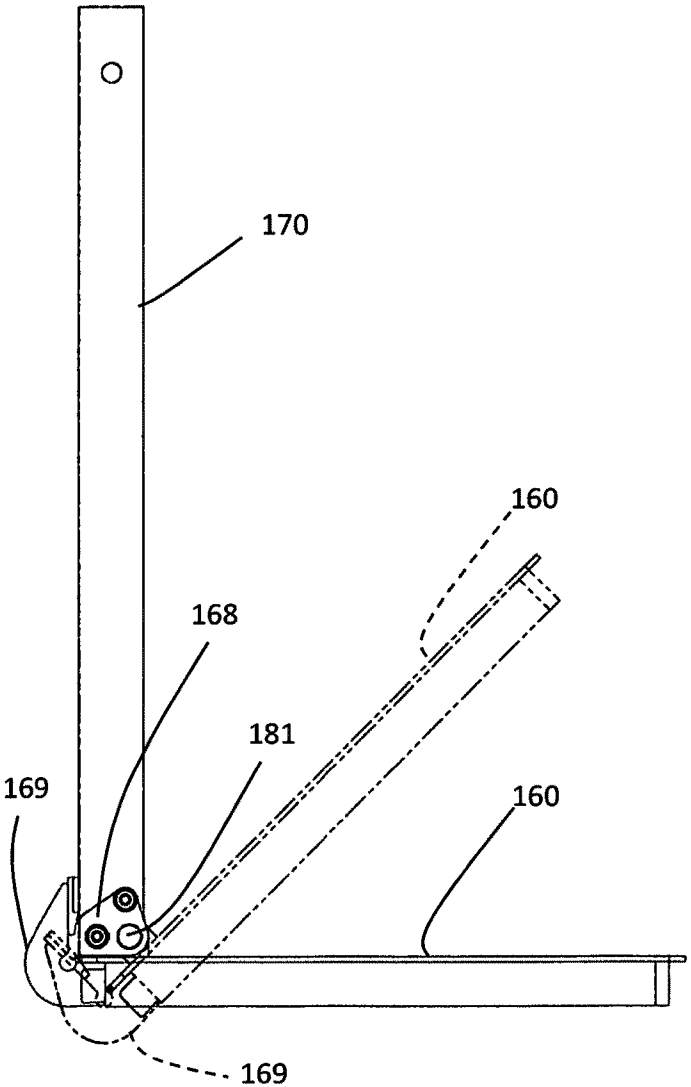
FIG. 27 is a side elevation view of the floor of FIG. 24 when moving between the deployed and stowed positions, showing the cam moving from its stalk contact position.

Referring now to FIGS. 6 to 28, embodiments of a personnel basket 100 for attachment to a crane boom includes a front wall 120, a rear wall 150, left and right sidewalls 130A, 130B, and a floor 160. The floor 160 is a one-piece floor in hinged or pivotal relation to the rear wall 150. The left and right sidewalls 130A, 130B are in pivotal relation to the front and rear walls 120, 150. The rear wall 150 is non-pivoting and includes a mast or stalk 170, a portion 180 of which is integral to the rear wall 160. A method of folding and unfolding the basket 110 includes the steps and order shown in the drawing figures.

Similar to the embodiments of FIGS. 1 to 5, the walls 120, 130, 150 may be made up of a top rail 81, an intermediate (mid) rail 83, and a toe rail or board 85 all in fixed relation to their respective wall. The top rail 81 may include a locking bar 82 that moves or slides axially to lock the sidewalls 130 in line with the rear wall 150. When the bar 82 is in an unlocked position, the sidewalls 130 can fold toward the rear wall 150. In embodiments that include a fixed sidewall section 133 and a folding sidewall section 139, the locking bar 82 locks the folding section 139 in line with the fixed section 133. The basket 110 may be self-leveling and may include a hand brake 190. Fall arrest and safety features should also be included. As with other embodiments, the floor 160 may include a slip resistant surface of a kind known in the art. Means for providing water drainage may also be provided.

The stalk 170 is configured for connection to the crane boom using any suitable means. In embodiments, the stalk 170 includes a crane boom or crown attachment connection 171 located toward an upper end 173 of the stalk 170. The boom connection 171 may include a pinned connection 175. The stalk 170 may be releasably connected to the wall 150 or may form a permanent mid-section 151 of the wall 150, with a left and a right rear wall section 151A, 151B connected to the stalk 170. In some embodiments, the stalk 170 is a forward projecting portion of the wall 150 (thereby intruding into a portion of the floor 160). In other embodiments, the stalk is a rearward projecting portion of the wall 150. Regardless of the construction, the rear wall 150, as well as the stalk 170, remains in a vertical orientation as the basket 100 is folded or unfolded, and as the basket 100 moves between these two states. In other words, the walls 120, 130 and the floor 160 move relative to the fixed position of the rear wall 150 and stalk 170.

In embodiments, the front wall 120 is pivotally connected at one end 121 to an adjacent end 131 of one of the sidewalls 130A, 130B and serves as a doorway. A locking or latch mechanism 125 may be located at another end 123 of the front wall 120 and used to keep the doorway in a closed position. The front wall 120 is moveable between a deployed state and a folded state. When in a deployed state, the front wall 120 is perpendicular to a corresponding one of the left and right sidewalls 130A, 130B. When in the folded state, the front wall 120 overlaps an opposing portion of a corresponding one of left and right sidewalls 130A, 130B. In both the deployed and stowed states, and as they move between these states, the front wall 120 and left and right sidewalls 130A, 130B remain in a vertical orientation. The front wall 120 may include a flange 127 at a bottom end 129.

The left and right sidewalls 130A, 130B may include a fixed sidewall section 133 and a folding sidewall section 139. The fixed sidewall section 133 is the shorter length section and the folding wall sidewall section 139 is the longer length section. The fixed sidewall section 133 is connected at one end 135 to an adjacent end 155 of the rear wall 150 and at another end 137 to the pivoting wall section 139. The front wall 120 is pivotally connected to the end 131 of a corresponding one of the folding sidewall sections 139A, 139B. In other embodiments, one or both sidewalls 130A, 130B may be a folding sidewall with the fixed sidewall section 133 not included. The folding sidewall section 139 of those embodiments is connected at one end 137 to the rear wall 150. In some embodiments, one sidewall 130 may include a doorway with a locking mechanism similar to that of latch 125.

Each of the folding sidewall sections 139 are moveable between a deployed state and a folded state. When in the deployed state, the folding sidewall section 139 is perpendicular to the rear wall 150. When in the folded state, the folding sidewall section 139 overlaps an opposing portion of the rear wall 150. In both the deployed and folded states, and as they move between these states, the rear wall 150 and folding sidewall sections 139 remain in a vertical orientation, as does the fixed sidewall sections 133.

In embodiments, the floor 160 is a one-piece floor that is connected by a hinge block 168 to a bottom end 159 of the rear wall 150. The hinge block 168 may include a hinge or pin 181 that connects the floor 160 to the stalk 170. The floor 160 includes a cam or stop 169 that transmits downward force on the floor 160 to the stalk 170 when the floor 160 is in the deployed (horizonal) position. (The cam or stop 169 is in a first (vertical) orientation when the floor is in the deployed (horizontal) position and being in a second (horizontal) orientation when the floor is in the stowed (vertical) position. See e.g. FIGS. 24-28.) The stop 169 may include slotted portions 179 where material is removed from the stop 169 to save weight. See e.g. FIG. 10. The floor 160 moves toward or away from the wall 150 during deployment or stowage.

When in the deployed state, the floor 160 is perpendicular to the rear wall 150 with flanges 132 of the sidewalls 130 resting on the floor 60. When in the folded state, the floor 160 overlaps an opposing portion of the rear wall 150. In both the deployed and folded states, and as the floor 160 moves between these states, the rear wall 150 remains in a vertical orientation. The floor 160 may include pins 165 that are received by corresponding holes 134 in the flanges 132. A sliding locking plate 136 may then be used to lock the pins and fasten the floor to the sidewalls 130.

In some embodiments, the floor 160 includes a cam or stop 169 located at its rearward end 161 to transmit downward force on the floor 160 to the stalk 170. When the floor 160 is in the deployed position (perpendicular to the stalk 170), one face 174 of the cam or stop 169 comes into a vertical orientation to contact with the rearward surface 185 of the stalk 170 or rear wall 150 which stops further rotation downward by the floor 170. See FIGS. 13, 15 & 20 (note the stalk 170 forms an integral part of the rear wall 150). The face 174 that contacts the rearward surface 185 also serves to redirect some of the downward force of the floor 160 itself (both unloaded, but more importantly when loaded) to the back of the stalk 160, placing the stalk 170 under a compressive load. The face 174 may include a wear pad 176. The other portion of the downward force can be transmitted through the pin 181 xxx that connects the floor 160 to the stalk 170. See FIGS. 16 & 24-28

In embodiments, when in the folded state, the floor 160, the folding sidewall sections 133, and the front wall 120 are vertical and overlap respective opposing portions of the rear wall 150. In some embodiments, the floor 160 and the folding sidewall sections 139 lie between the rear wall 150 and the front wall 120. In other embodiments, the floor 160 lies between the folding sidewall sections 139 and the rear wall 150. The deployed state perimeter or footprint 111 is more than twice that of the folded state perimeter or footprint 113 (the footprints lying in a horizontal plane perpendicular to the rear wall 150 and being measured when the rear wall 150 is in a vertical orientation). In some embodiments the folded state footprint is less than one-half, one-third, one-fourth, or one-fifth of the deployed state footprint. By way of a non-limiting example, in one embodiment the depth of the basket (as measured front-to-back) between the deployed and folded footprints was 3:1 (e.g., 30 inches to 10 inches).

Unlike the personnel basket of US 2016/0257543, embodiments of a personnel basket of this disclosure do not make use of a collapsible (folding or pivoting) spine, a floor with a stationary middle third and adjacent upward pivoting sections, or removable, foldable rail assemblies, all of which must be assembled and then disassembled for storage. Rather, the walls and doors are connected to the rear wall/stalk and remain so during deployment and folding and it is not necessary to remove them for storage. The embodiments of this disclosure make use of a single door and latch mechanism as opposed to two swinging doors. Additionally, embodiments of this disclosure may use different crane attachment mechanisms than those of US 2016/0257543.

While embodiments have been described and examples provided, modifications may be made to the details of construction without departing from the scope of the following claims. The elements and limitations recited in these claims are entitled to their full range of equivalents.

What is claimed:

1. A personnel basket for attachment to a crane boom, the personnel basket comprising:

a rear wall including a stalk integral to the rear wall and forming a fixed midsection of the rear wall, the stalk including a boom connection located toward an upper end of the stalk;

a left and a right sidewall, each sidewall including:

a fixed sidewall section fixedly connected at a rearmost end to the rear wall, a folding sidewall section pivotally connected to a foremost end of the fixed sidewall section, the folding sidewall section having a greater length than the fixed sidewall section, and a top rail including a locking bar configured to align the folding sidewall section with the fixed sidewall section;

a front wall pivotally connected to a corresponding one of the folding sidewall sections; and a one-piece floor in pivotal relation to the rear wall;

wherein the left and right sidewalls, the front wall, and the floor pivot toward and away from the rear wall between a deployed state and a folded state, the rear wall remaining in a fixed position between the deployed and folded states;

wherein when in the deployed state the floor is perpendicular to the rear wall and when in the folded state the entire floor overlaps the rear wall; and wherein when in the deployed and folded states:

the left and right sidewalls, the front wall, the rear wall, and the floor remain connected to one another; and the left and right sidewalls, the front wall, and the rear wall being in a same orientation as one another;

the personnel basket further comprising:

a hinge block including a pin connecting the floor to the stalk; and the floor including a stop at a rearward end;

wherein when in the deployed state a face of the stop contacts a rearward surface of the rear wall and when in the folded state the face of the stop does not contact the rearward surface of the rear wall.

2. The personnel basket of claim 1, wherein when in the folded state:

the front wall is overlapping the corresponding one of the left and right sidewalls, the front wall and left and right sidewalls remaining in a vertical orientation and connected to one another in the folded state.

3. The personnel basket of claim 1, wherein when in the folded state the folding sidewall section overlaps the rear wall.

4. The personnel basket of claim 1, wherein in the folded state the floor, the folding sidewall sections, and the front wall overlap the rear wall.

5. The personnel basket of claim 4, wherein in the folded state the floor and the folding sidewall sections lie between the rear wall and the front wall.

6. The personnel basket of claim 5, wherein in the folded state the floor lies between the folding sidewall sections and the rear wall.

7. The personnel basket of claim 1, further comprising:

the personnel basket having a deployed state footprint and a folded state footprint, the folded state footprint being less than half that of the deployed state footprint, said footprints lying in a horizontal plane perpendicular to the rear wall and being measured when the rear wall is in a vertical orientation.

8. The personnel basket of claim 7, wherein the folded state footprint is less than one-third of the deployed state footprint.

9. The personnel basket of claim 1 further comprising the rear wall, the left and right sidewalls, and the front wall each including a fixed railing.

10. The personnel basket of claim 1 further comprising the left and right sidewalls each including a flange located at a bottom end.

11. The personnel basket of claim 10 further comprising:

the flange including a sliding locking plate having one or more holes; and the floor including one or more pins, each pin arranged to be received by a corresponding hole of the sliding locking plate when the basket is in a deployed state.

12. The personnel basket of claim 1 further comprising the front wall including a doorway with a locking mechanism.

13. A personnel basket for attachment to a crane boom, the personnel basket comprising:

a fixed rear wall including a stalk integral to the wall and a boom connection located toward an upper end of the stalk;

a left and a right sidewall, each sidewall including a folding sidewall section in pivotal relation to the fixed rear wall and including a top rail containing a locking bar connectable to the fixed rear wall;

a front wall pivotally connected to a corresponding one of the folding sidewall sections; and a floor in pivotal relation to the fixed rear wall;

the folding sidewall sections, the front wall, and the floor being pivotable between a deployed state and a folded state and remaining connected to one another between the deployed and folded states;

wherein when in the deployed state the locking bar is in a connected state and the folding sidewall sections are in a vertical orientation and are perpendicular to the rear wall, the front wall, and the floor; and wherein when in the folded state, the entire floor overlaps the rear wall and the folding sidewall sections remain in the vertical orientation and are parallel to the entire rear wall, the entire front wall, and the entire floor;

the personnel basket further comprising:

a hinge block including a pin connecting the floor to the stalk; and the floor including a stop at a rearward end;

wherein when in the deployed state a face of the stop contacts a rearward surface of the rear wall and when in the folded state the face of the stop does not contact the rearward surface.

14. The personnel basket of claim 13 further comprising:

at least one of the left and right sidewalls including a fixed sidewall section;

the fixed sidewall section connected at one edge to the fixed rear wall and at another edge to the folding sidewall section.

15. A personnel basket for attachment to a crane boom, the personnel basket comprising:

a left and a right sidewall each including:

a fixed sidewall section;

a folding sidewall section located at a foremost end of the fixed sidewall section; and a top rail including a locking bar configured to align the folding sidewall section with the fixed sidewall section;

a rear wall in fixed relation to the fixed sidewall sections and connected to a rearmost end of the fixed sidewall sections;

a front wall in pivotal relation to a corresponding one of the folding sidewall sections;

a floor in pivotal relation to the rear wall; and a stalk connected to the rear wall and including a boom connection at an upper end;

the personnel basket being moveable between a deployed state and a folded state;

wherein when in the deployed state the folding sidewall sections are in a vertical orientation and are perpendicular to the rear wall, the front wall, and the floor; and wherein when in the folded state, the folding sidewall sections remain in the vertical orientation, connected to one another, and are parallel to the entire rear wall, the front wall, and the entire floor;

the personnel basket further comprising:

a hinge block including a pin connecting the floor to the stalk; and the floor including a stop at a rearward end;

wherein when in the deployed state a face of the stop contacts a rearward surface of the rear wall and when in the folded state the face of the stop does not contact the rearward surface of the rear wall.

* * * * *